United States Patent [19]

Shapland

[11] Patent Number: 4,556,157

[45] Date of Patent: Dec. 3, 1985

[54] PRESSURE FLUID TEEMING VALVE AND METHOD

[75] Inventor: Earl P. Shapland, Sarasota, Fla.

[73] Assignee: Flo-Con Systems, Inc., Champaign, Ill.

[21] Appl. No.: 381,063

[22] Filed: May 24, 1982

[51] Int. Cl.[4] ..... B22D 41/08

[52] U.S. Cl. ..... 222/600; 222/561

[58] Field of Search ..... 222/598, 599, 600, 511, 222/512, 561, 513, 591, 594, 597

[56] References Cited

U.S. PATENT DOCUMENTS

| | | | |
|---|---|---|---|
| 3,480,186 | 11/1969 | Grosko | 222/600 |
| 3,850,351 | 11/1974 | Yoshihara | 222/598 |
| 4,000,837 | 1/1977 | Walther | 222/512 |
| 4,063,668 | 12/1977 | Shapland et al. | 222/600 X |
| 4,116,372 | 9/1978 | Horiguchi et al. | 222/512 X |
| 4,176,769 | 12/1979 | Cudby et al. | 222/591 |
| 4,358,034 | 11/1982 | Hind . | |
| 4,424,958 | 1/1984 | Bachmann | 222/600 X |

FOREIGN PATENT DOCUMENTS 2459568 1/1976 Fed. Rep. of Germany ..... 222/600

*Primary Examiner*—Joseph J. Rolla
*Assistant Examiner*—Kenneth Noland
*Attorney, Agent, or Firm*—Jack E. Dominik

[57] ABSTRACT

Refractory plate valves are shown for controlling flow of molten material with structure providing a uniform controllable variable sealing pressure over the entire area of the sliding plate surface which surrounds the depending nozzle sufficient to deflect the refractory plates into a sealing relationship to prevent the intrusion of the molten material between the plates. The uniform pressure is applied to the sliding plate by pressurizing a fluid within a chamber in the sliding gate carrier that is immediately below a flexible diaphragm supporting the sliding plate. This pressure is applied from an external or internal source and may be controlled during the tapping and teeming phases of the use cycle and additionally may be completely relieved for ease of opening and closing of the device during the service phase of the cycle.

63 Claims, 16 Drawing Figures

PRESSURE FLUID TEEMING VALVE AND METHOD

BACKGROUND OF THE INVENTION

1. Field of the Invention

The present invention is directed to valves for the control of the flow of molten material from a vessel, and more particularly such valves as exemplified in Shapland U.S. Pat. No. 3,352,465 reissued as U.S. Pat. No. Re. 27,237 and Shapland and Shapland U.S. Pat. No. 4,063,668 and Shapland U.S. Pat. No. 4,314,659. In both of these devices pressure is applied to opposed refractory plates in the valve which can permit teeming or shutting the same off or indeed throttling depending upon the mode of operation desired.

2. The Prior Art

Attempts have been made for one hundred years or more to develop an external device to control the flow of molten material from a vessel. One of the earliest devices is disclosed in the Lewis U.S. Pat. No. 311,902 issued in 1885. A number of improvements of this device have been patented over the years but none of them was commercially successful until in the 1960's. Then the need to hold molten metal in a vessel for longer periods and the need to teem for longer periods was brought on by the advent of the continuous casting of steel. At that time, the Interstop valve based on the Lewis patent and the Flo-Con Systems, Inc. valve based on the Shapland U.S. Pat. No. 3,352,465 (re-issued as U.S. Pat. No. Re. 27,237) utilizing valve plate yieldable edge support through first class, spring forced levers were used for such control. Since that time, others have entered the field and a number of improvement patents relate to the means of attaching the devices to the vessel to allow easier service or alternate methods for applying the sealing pressure. Significant of the later of these is the Grosko and Shapland U.S. Pat. No. 3,604,603 showing fluid pressure enclosing tubes located under the edges parallel to travel of a sliding plate and Shapland and Shapland U.S. Pat. No. 4,063,668 which discloses a sliding plate supported by a plurality of pressure devices distributed under the plate. Physical limitations on the location of these pressure devices prevent obtaining uniform pressure over the entire sliding plate surface. Mechanical spring devices are subject to loss of force at high temperature and sealed pressure units used in place of mechanical springs may result in excessive sealing forces at elevated temperatures. Uncontrolled sealing forces may result in high sliding force requirements and make opening and closing of the device for refractory replacement difficult.

SUMMARY OF THE INVENTION

This invention relates, in a molten material sliding plate valve structure, to the obtaining of a uniform controllable variable sealing pressure over the entire area of the sliding plate surface which surrounds the depending nozzle sufficient to deflect the refractory plates into a sealing relationship with any mating plate to prevent the intrusion of the molten material between the plates. One of the embodiments described further provides for peripheral support to prevent breakout even if thermal and abrasive wear of the plates allows formation of a fin of solidified material between the plates. The uniform pressure is applied to the sliding plate by pressurizing a fluid within a chamber in the sliding gate carrier that is immediately below a flexible diaphragm supporting the sliding plate. The flexible diaphragm is preferably made of a material having a high strength at elevated temperatures such as 316 stainless steel and is drawn from sheet material thin enough to be adequately flexible. This thickness may range from 0.015 to 0.075 inches depending on the size of the valve plates used. This pressure is applied from an external or internal source and may be controlled during the tapping and teeming phases of the use cycle and additionally may be completely relieved for ease of opening and closing of the device during the service phase of the cycle. The principle of this invention is applicable to sliding valves of either the reciprocating style valves as shown in U.S. Pat. No. 3,352,456 reissued as U.S. Pat. No. RE. 27,237 and U.S. Pat. No. 4,063,608 or rotary style valves as shown in Shapland U.S. Pat. No. 4,314,659 and also valves of either the two plate or three plate variety. The principle is also applicable to valves of the sequential style as shown in Shapland U.S. Pat. No. 3,352,465 reissued as U.S. Pat. No. RE. 27,237, in which individual plates are sequentially pushed or pulled under the opening to control flow. Likewise, various methods of attachment, of opening and closing of the valve for servicing, or the means of reciprocating or rotating the sliding plate may be employed.

The uniform pressure principle is applicable to refractories which are metal encased, bonded in, or banded, and to refractories which are symmetrical or assymmetrical. The stationary and sliding plates may optionally be identical or of different shape and/or thickness.

DESCRIPTION OF THE DRAWINGS

The foregoing objects and advantages of the present invention will become more apparent as the following description of an illustrative embodiment of the invention takes place, taken in conjunction with the accompanying illustrative drawings, in which.

DESCRIPTION OF PREFERRED EMBODIMENTS

Figure 1:
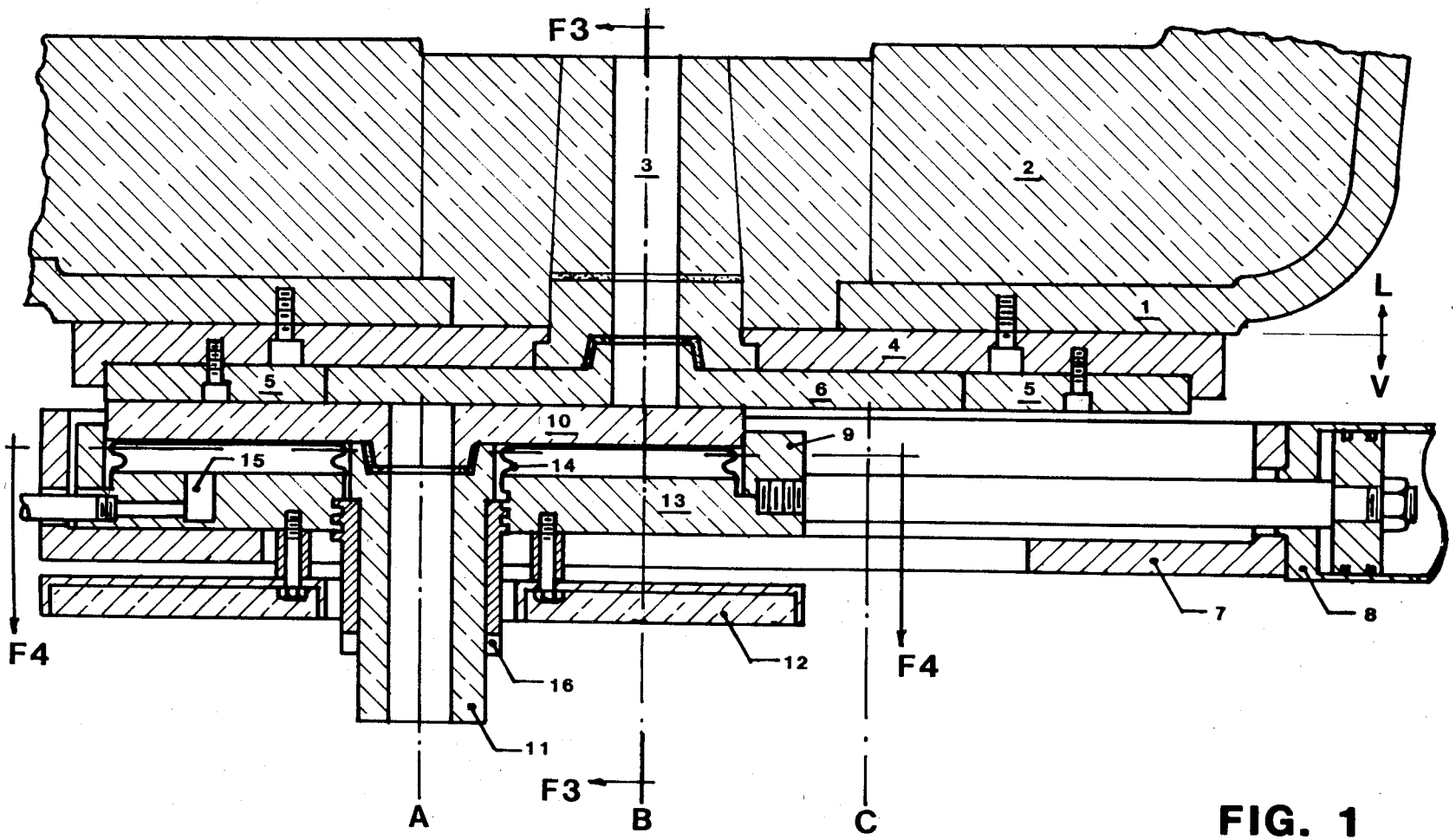
FIG. 1 is a longitudinal centerline sectional view of the first alternate embodiment of the device shown in one of its closed or shut off positions with the orifice in the sliding plate at vertical centerline A. This section line is shown as F1—F1 in FIG. 3.

The longitudinal section of FIG. 1 shows a vessel L, in this instance a bottom teeming ladle having a metal outer shell 1, with level plate in its bottom to provide a level surface for attaching the mounting plate 4, of the valve V. The vessel L, has a refractory lining 2 with an opening 3 centered over the valve V.

The valve V has a mounting plate 4 bolted to the level bottom of the ladle outer shell 1. Retained against the mounting plate 4 by backing plates 5 is a stationary refractory orifice plate 6.

Removably attached to the mounting plate 4 is the frame 7 of the valve V. Attached to the frame 7 is the operating device 8, in this instance a hydraulic cylinder which is used to shift the valve carrier 9. The carrier 9, in turn, shifts the sliding refractory plate 10, the depending refractory nozzle 11, and the sliding heat shield 12 so that the centerline of the orifice in the sliding refractory plate 10 and the depending refractory nozzle 11 can be shifted into alignment with the orifice of the stationary refractory orifice plate 6, at centerline B, to allow teeming. When the carrier 9 is shifted toward either centerline A or C the orifice of the sliding refractory plate 10 is shifted out of alignment with the orifice of the stationary refractory plate to first throttle the stream and then to completely shut off the stream and thus stop teeming. The backing plates 5 also serve to restrain the portion of the sliding plate 10 which overlaps the stationary plate 6 from being upwardly deflected.

The valve carrier 9, has a rigid bottom portion 13, to which is welded continuously around its interior and exterior periphery a flexible convoluted diaphragm upper portion 14. A passage 15, connecting the chamber contained within the carrier 9 to an outside pressure fluid source, allows pressurizing of the chamber within the carrier. If cooling is desired, an alternate exhaust line connected to a pressure relief valve is supplied on the opposite side. This exhaust line is not shown.

The depending refactory nozzle 11 is held against the sliding refractory plate 10 by a nozzle retaining device 6 which in this illustration is a tubular threaded nut threaded into the rigid carrier bottom portion 13. Also attached to the rigid carrier bottom portion 13 is the sliding heat shield 12.

Figure 2:
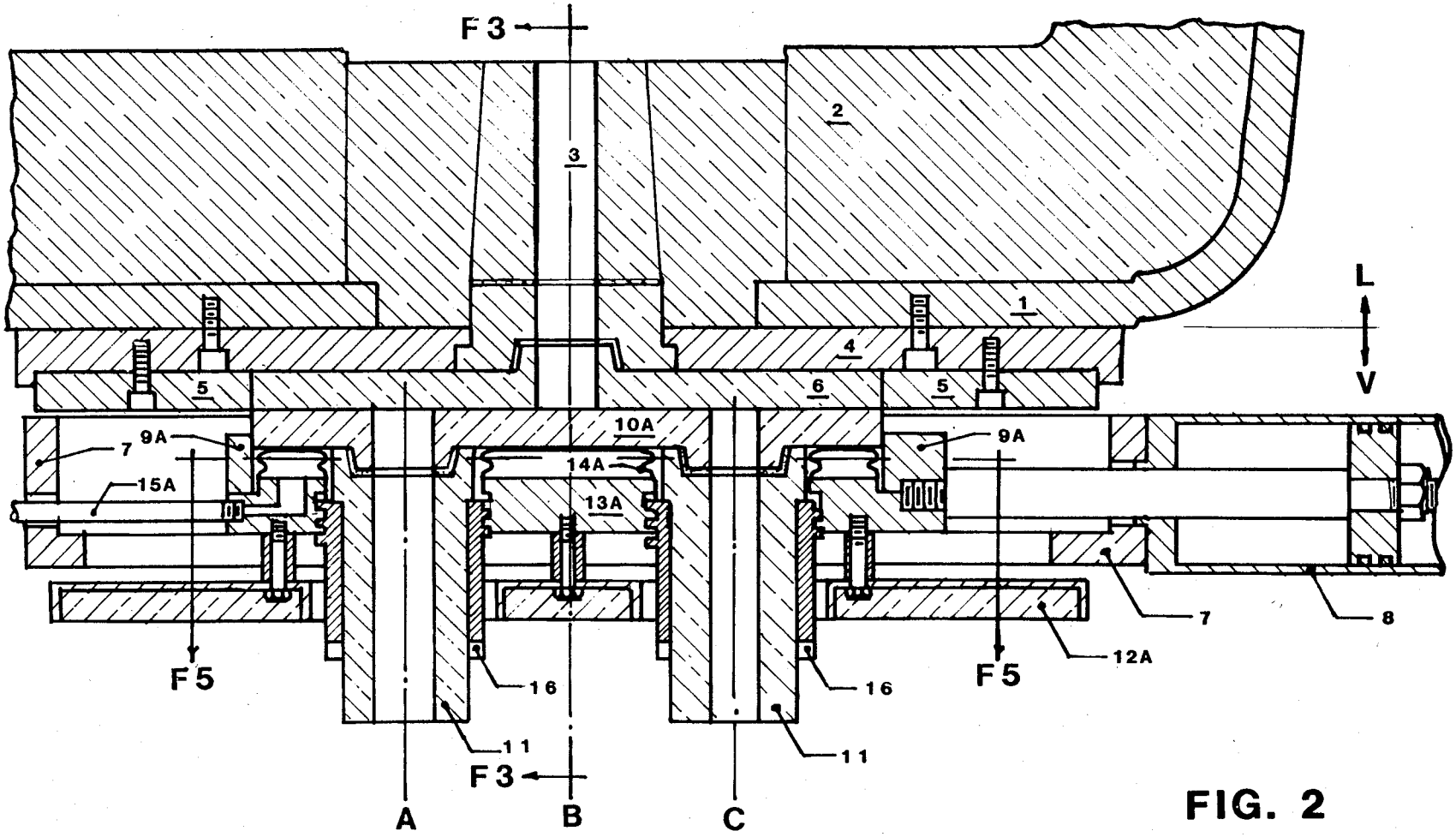
FIG. 2 is a longitudinal centerline sectional view of a variation of the device shown in FIG. 1 utilizing two teeming orifices in the sliding plate. This variation of the device is also shown in a closed or shut off position with the teeming orifices in the sliding plate at vertical centerlines A and C.

FIG. 2 shows a variation of the device of FIG. 1 utilizing a sliding portion with two teeming orifices. As shown here, the two orifices are normally of different bore sizes to provide different full open teeming rates. Either of the sliding orifices may be aligned with the stationary refractory orifice plate 6, at centerline B or shifted out of alignment as shown to provide shut off.

Figure 3:
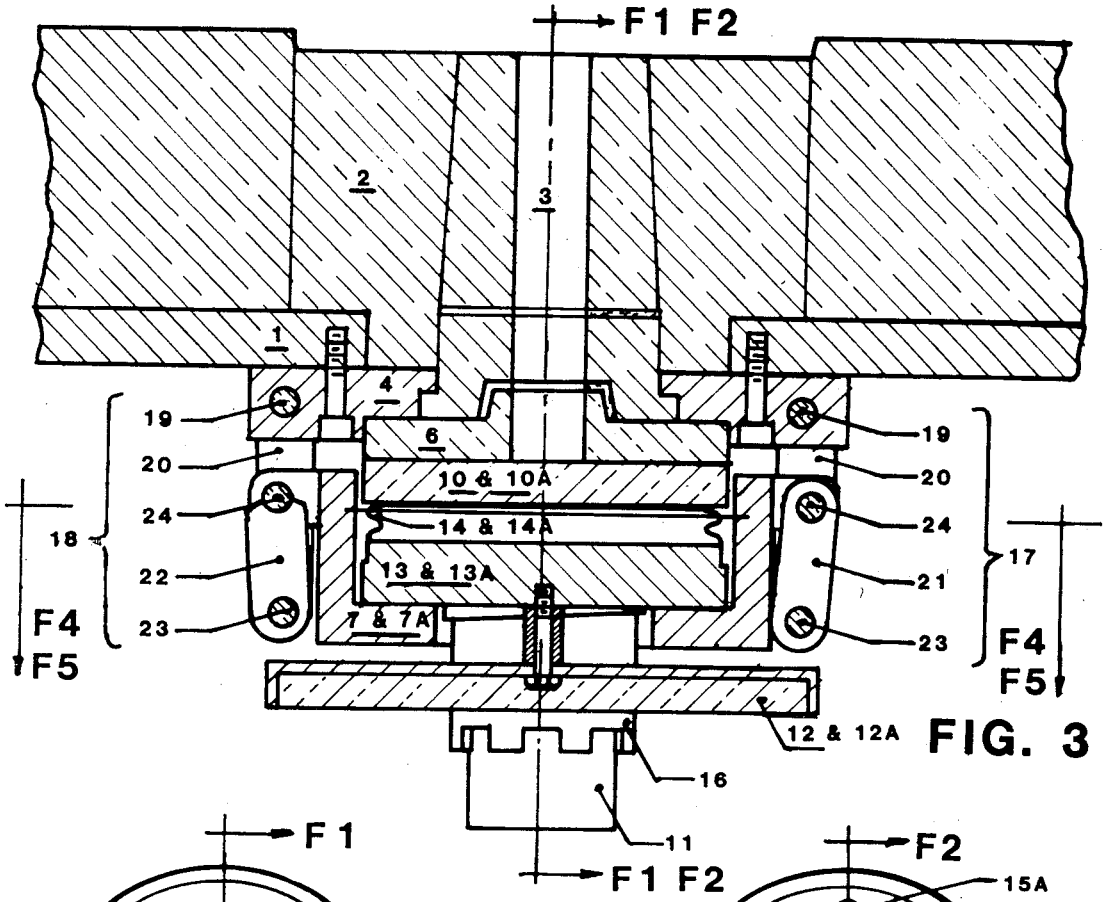
FIG. 3 is a transverse sectional view of the device of FIG. 1 and variation of FIG. 2 taken at section F3—F3 of FIGS. 1 and 2.

FIG. 3 is a transverse cross-section of the device of FIG. 1 and also represents a cross-section of the variation of FIG. 2 (both cross-sections being identical) showing the toggle hinge linkage 17, and toggle latch linkage 18, that removably attach the valve frame 7 and its attached and contained components including the valve carrier 9, in a non-adjustable positioned relationship to the mounting plate 4. The hinge toggle linkage 17 includes a pin 19 connecting the mounting plate 4 to the long toggle link 20. The pin 23 connects the short hinge link 21 to the long toggle link 20, and the pin 24 connects the short link 21 to the frame 7. The latch toggle linkage 18 includes a pin 19 connecting the mounting plate 4 to the long toggle link 20.

The pin 23 connects the long and short toggle links, and the pin 24 connects the short toggle link to the frame 7.

Figure 4:
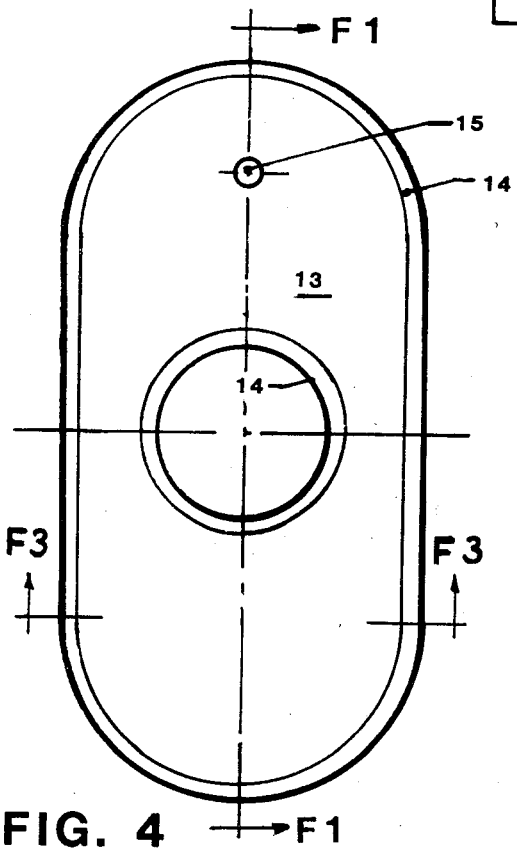
FIG. 4 is a horizontal sectional view of the chamber of the sliding plate carrier of the device of FIG. 1. This section is shown as F4—F4 of FIG. 1.

FIG. 4 shows a section through the chamber in the carrier 9 of the device of FIG. 1. Shown is the rigid bottom portion of the carrier 13, the convoluted diaphragm 14 and the fluid passage to the carrier chamber 15. This view illustrates how the chamber and its flexible convoluted diaphragm 14 contact the sliding refractory plate 10 over the entire area of the sliding refractory plate 10 surrounding the depending nozzle 11.

Figure 5:
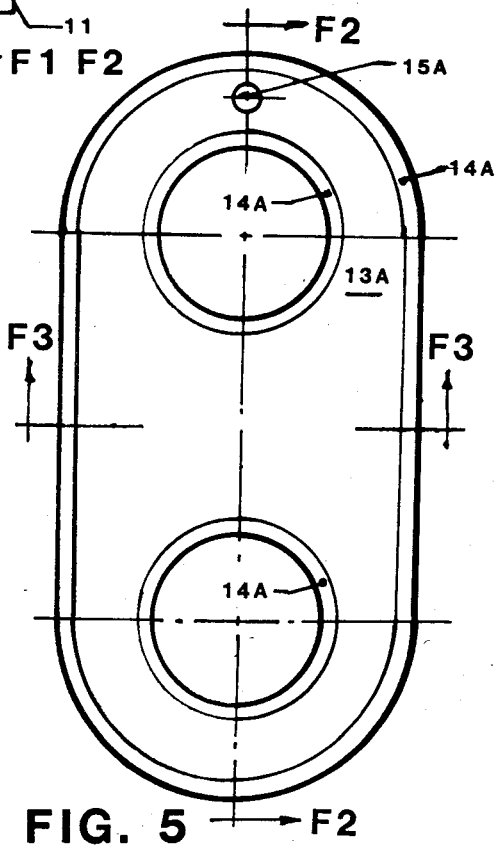
FIG. 5 is a horizontal sectional view of the chamber of the sliding gate carrier of the variation of the device shown in FIG. 2. This section is shown as F5—F5 of FIG. 2.

FIG. 5 shows a section through the chamber in the carrier 9A of the variation of the device of FIG. 2. The same components as shown in FIG. 4 are shown as they relate to the two orifice slide valves and this view illustrates how the entire area of the sliding refractory plate 10A surrounding two depending nozzles 11 is forced into sealing relationship with the stationary refractory orifice plate 6.

Figure 6:
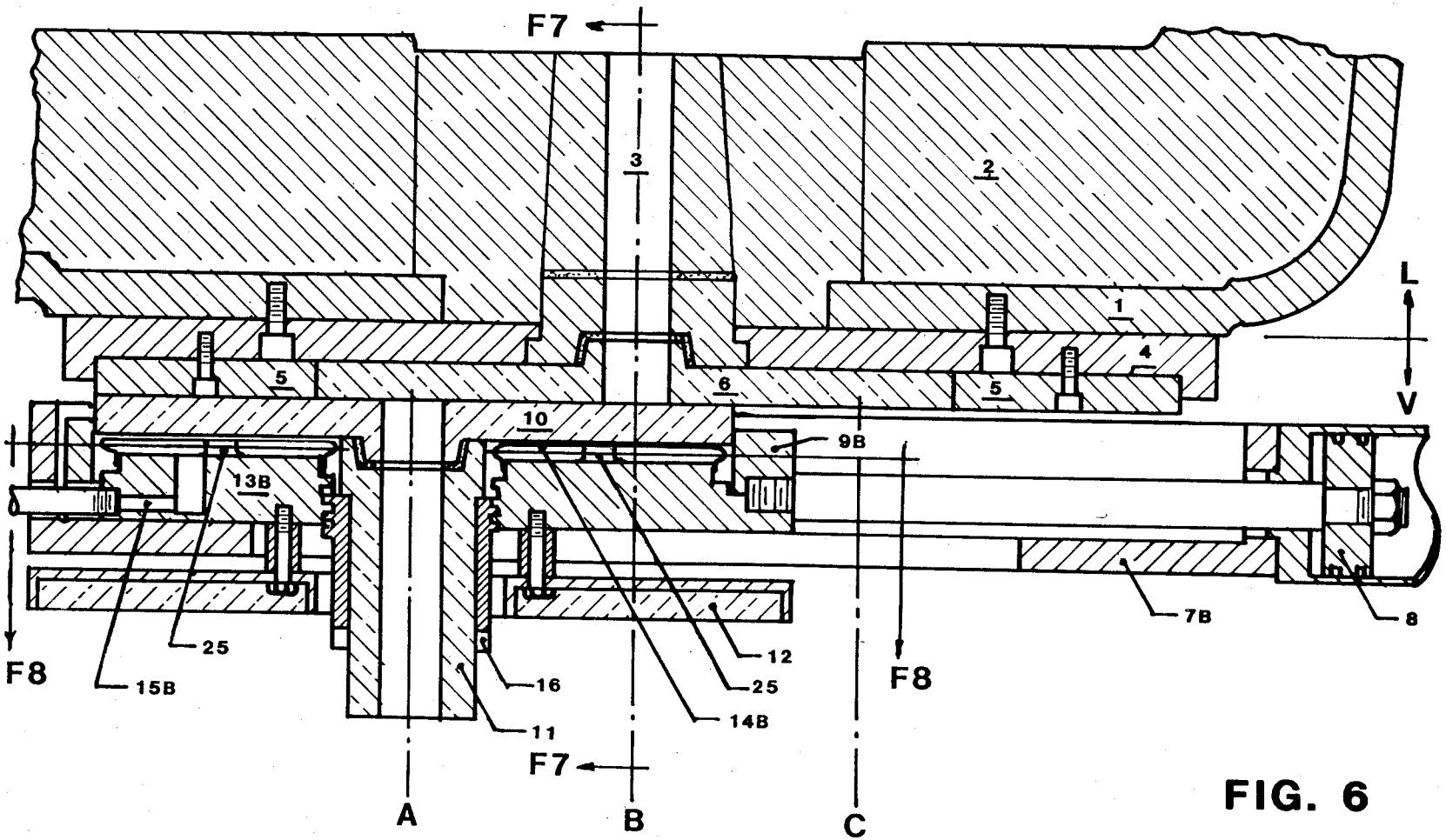
FIG. 6 is a longitudinal centerline sectional view of the second alternate embodiment of the device shown in one of its closed or shut off positions with the orifice in the sliding plate at vertical centerline A. This section line is shown as F6—F6 of FIG. 7.

FIG. 6 is a longitudinal centerline section of the second alternative embodiment of the device which utilizes adjustable means to attach the valve frame 7B to the mounting plate 4 so that boss type locators 25 that are within the valve carrier 9B locate and position the valve frame 7B and its attached and contained components in a positioned relationship to the mounting plate 4 that is controlled by the combined thickness of the installed stationary refractory orifice plate 6 and the installed sliding refractory plate 10. With this alternative embodiment a minimum travel of the flexible diaphragm upper portion of the carrier 14B is required and, therefore, it does not need to be convoluted resulting in a lower cost and longer life. The actual sealing force applied to the plates during teeming is still supplied by the fluid pressure within the chamber of the valve carrier 9B, but the stationary and sliding refractory plates are held in unyielding adjacent relationship sufficient to prevent leakage during the time that molten material is tapped into the ladle, when the opening 3, in the ladle refractory lining is filled with sand or other granular refractory material as is commonly practiced.

Figure 7:
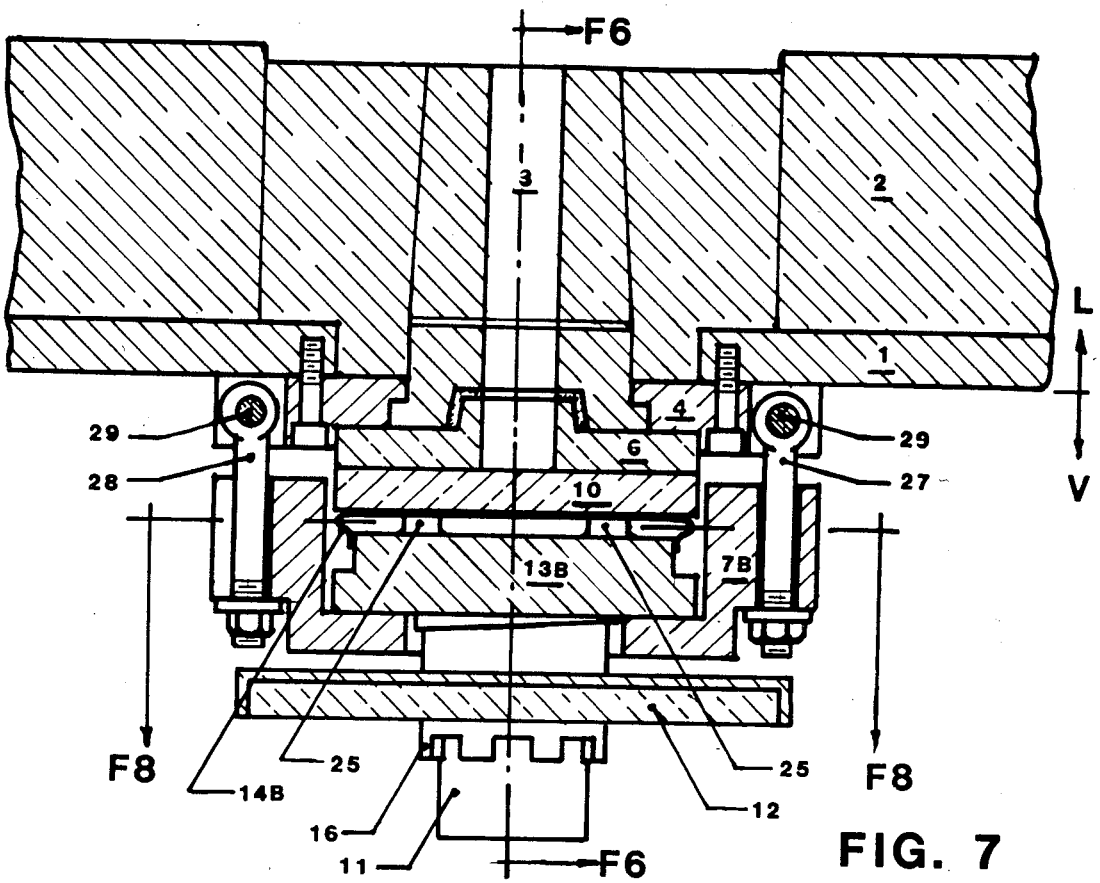
FIG. 7 is a transverse sectional view of the device of FIG. 6 taken at line F7—F7 of FIG. 6.

FIG. 7 is a transverse section of the second alternative embodiment shown in FIG. 6 showing the hinge acting swing bolt 27 that passes through a hole in the valve frame 7B. The latch acting swing bolt 28 which engages the valve frame 7B passes through a notch so that it can be loosened and swung out of the way so that the frame 7B may be hinged open while still attached to the hinge acting swing bolt 27. The swing bolts are attached to the mounting plate 4, by pins 29.

Figure 8:
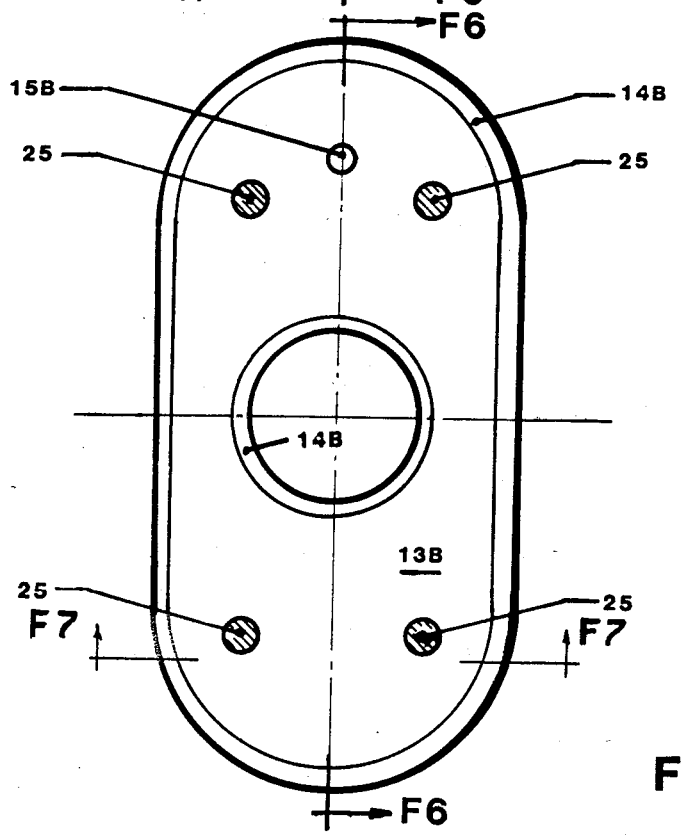
FIG. 8 is a horizontal sectional view of the chamber of the sliding plate carrier of the device of FIG. 6. This section line is indicated as F8—F8 of FIGS. 6 and 7.

FIG. 8 is a horizontal section through the fluid chamber of the valve carrier 9B of the device of FIGS. 6 and 7 and shows the rigid carrier bottom portion 13B, the flexible diaphragm upper portion 14B and the boss-type locators 25.

Figure 9:
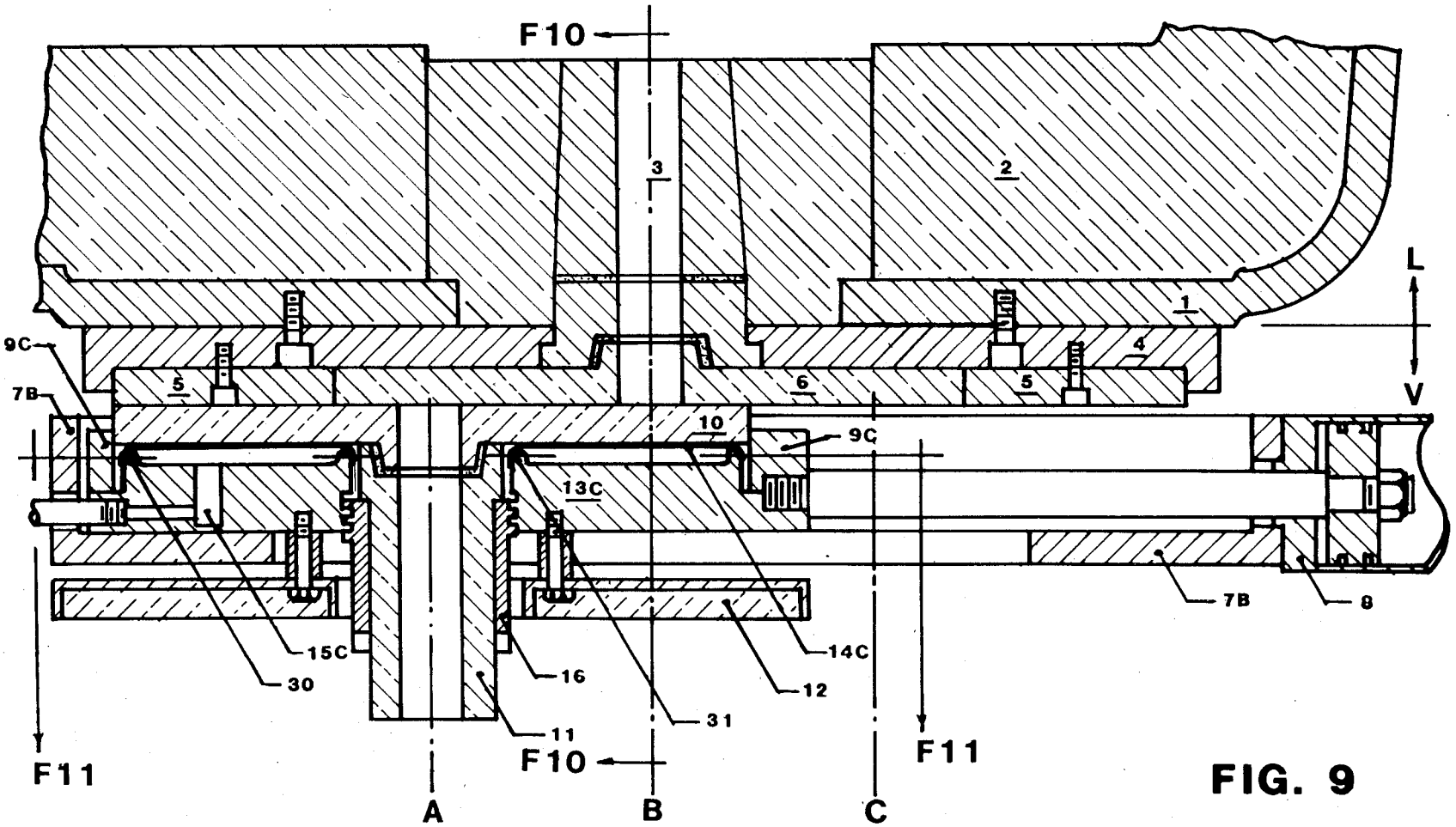
FIG. 9 is a longitudinal centerline sectional view of the third alternate embodiment of the device shown in one of its closed or shut off positions with the orifice in the sliding plate at vertical centerline A. This section line is shown as F9—F9 in FIG. 10.

FIG. 9 is a longitudinal centerline sectional view of the third alternative embodiment of the device which utilizes the same adjustable means to attach the valve frame 7B to the mounting plate 4 as the second alternative embodiment. However, in place of the boss-type locators of the second alternative embodiment, the third embodiment uses continuous peripheral non-yielding outer and inner raised edge supports 30 and 31 to locate and position the valve frame 7B and its attached and contained components including the valve carrier 9C in a positioned relationship to the mounting plate 4 that is, like the second alternative embodiment, controlled by the combined thickness of the installed stationary refractory orifice plate 6, and the installed sliding refractory plate 10. In this embodiment the inner and outer peripheral edges of the diaphragm 14C are cupped and fit over the peripheral outer and inner edge supports 30 and 31 of the carrier bottom portion 13C with the diaphragm edges welded to the carrier bottom portion 13C.

Figure 10:
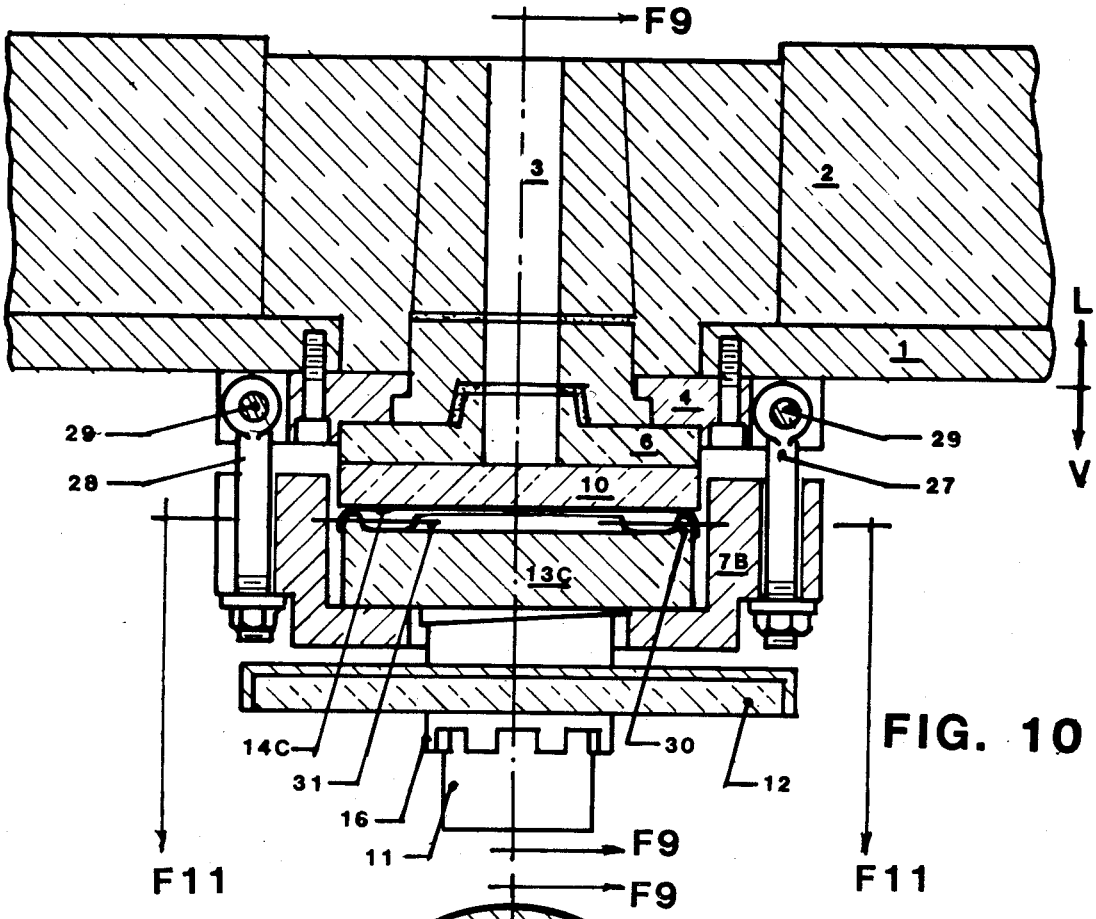
FIG. 10 is a transverse sectional view of the device of FIG. 9 taken at line F10—F10 of FIG. 9.

FIG. 10 is a transverse section of the third alternative embodiment shown in FIG. 9. The swing bolts 27 and 28 attach the valve frame 7B to the mounting plate 4. The continuous peripheral non-yielding outer and inner edge supports 30 and 31 are shown in this view.

Figure 11:
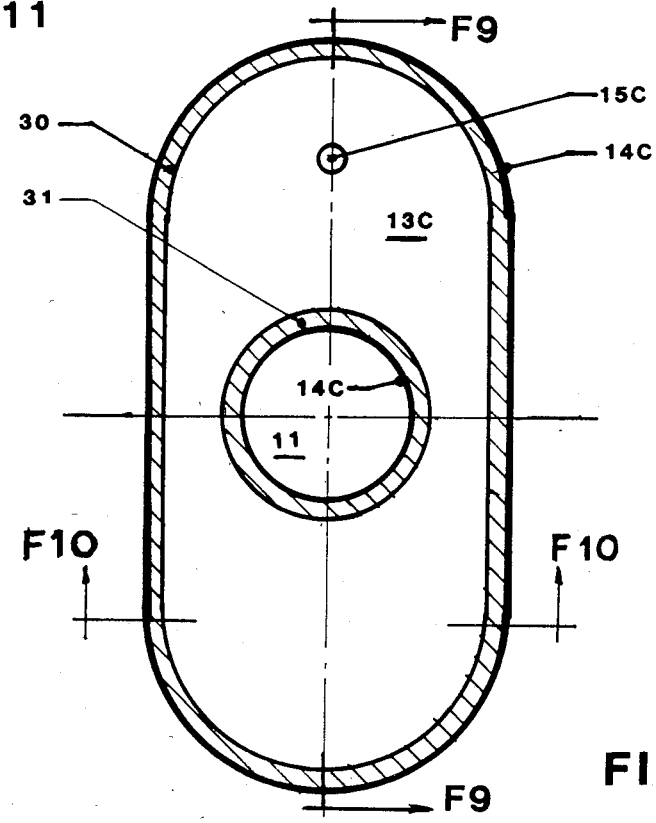
FIG. 11 is a horizontal sectional view of the chamber of the sliding plate carrier of the device of FIG. 9. This section line is indicated as F11—FII of FIGS. 9 and 10.

FIG. 11 is a horizontal section through the fluid chamber of the third alternative embodiment shown in FIGS. 9 and 10. This view shows how the continuous raised outer peripheral non-yielding support 30, and the continuous raised inner peripheral non-yielding support 31 which surrounds the depending nozzle 11 are arranged to assure support of the refractory plates 6 and 10 in the absence of fluid pressure in the system which could be either accidental or intentional.

Figures 12, 13:
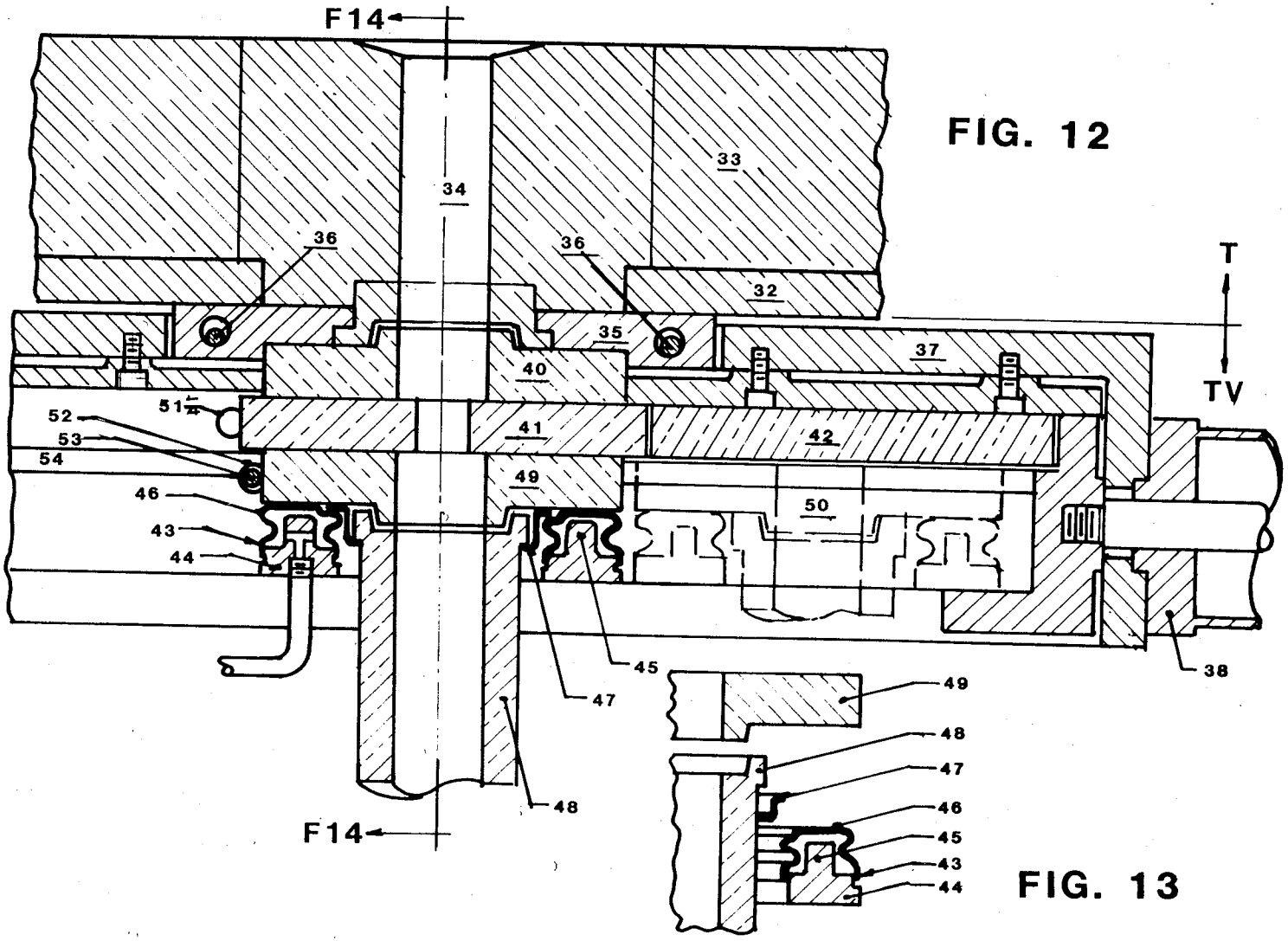
FIG. 12 is a longitudinal centerline sectional view of a valve of the three plate, sequential, throttling type illustrating the application of a carrier supplying a uniform sealing force in surrounding relationship of the teeming orifice. This section line of FIG. 12 is indicated as F12—F12 of FIG. 14.
FIG. 13 is an exploded view of the carrier, submerged pour tube support, submerged pour tube, and submerged pour tube top plate.
Figure 14:
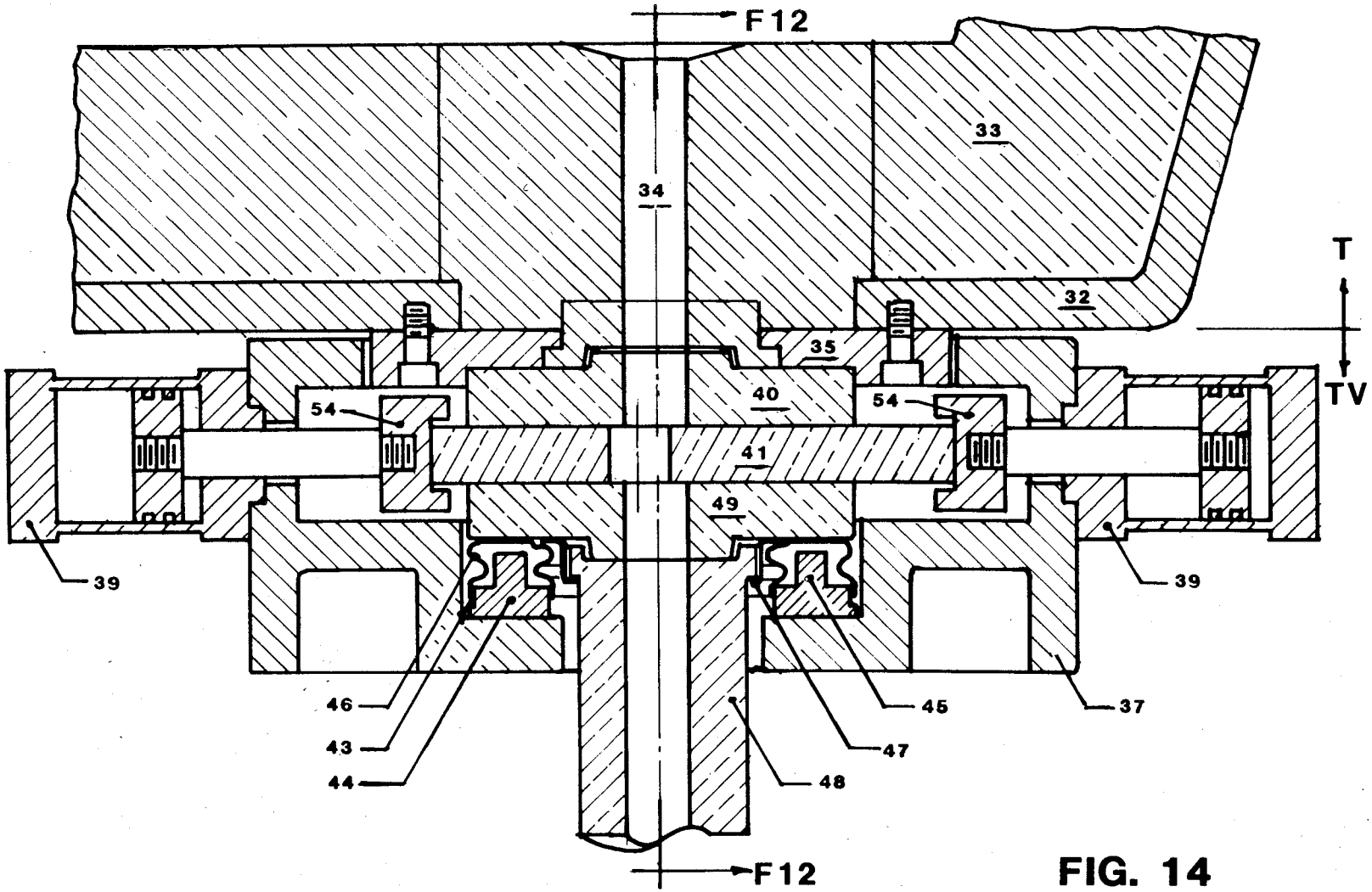
FIG. 14 is a transverse section of the valve of FIG. 12 taken along line F14—F14 of FIG. 12.

FIGS. 12, 13, and 14 illustrate a three plate sequential throttling tundish valve TV. FIG. 12 is a longitudinal section which is indicated as F12—F12 in FIG. 14. FIG. 14 is a transverse section which is indicated as F14—F14 in FIG. 12. Illustrated in these views are a tundish T or intermediate teeming vessel used principally in continuous casting and the three plate sequential throttling tundish valve TV. The tundish T has an outer metal shell 32, a refractory lining 33 and an orifice 34 in the refractory lining 33. The tundish valve TV, has a mounting plate 35 which is bolted to the tundish outer metal shell 32 and suspended from the mounting plate 35 by the support pins 36 is the tundish valve frame 37. Attached to the tundish valve frame 37 are the valve plate and submerged pour tube changing cylinder 38 and the opposed throttling cylinders 39. Carried within the tundish valve frame 37 are the stationary top refractory orifice plate 40, the sliding throttle orifice plate 41, a sliding imperforate plate 42, a changeable valve plate carrier 43, supporting in this illustration a submerged pour tube 48 suspended by the depending nozzle inwardly extending support flange 47, and a submerged pour tube plate 49. The changeable valve plate carrier 43 has a rigid bottom structure 44 with a flexible annular diaphragm top 46. The rigid bottom structure 44 illustrated has a travel limit portion 45 which prevents overtravel of the convolutions of the top diaphragm portion 46 which could result in permanent deflection. For clarity, these items are shown in an exploded view in FIG. 13. Optionally the flange 47 may be integral with the diaphragm 46 as shown in FIGS. 12–14.

Also illustrated in FIG. 12 is a phantom outline of a carrier 43, submerged pour tube 48 and submerged pour tube plate 49 in the ready position. This assembly is indicated with reference numeral 50. Shown in the tundish valve frame 37 are the throttling plate stop pin hole 51, the submerged pour tube plate stop pin hole 52 and the stop pin 53 inserted in the submerged pour tube stop pin hole 51. Shown best in FIG. 14 are the throttling cylinder operated sliding throttling plate rails 54.

Figure 15:
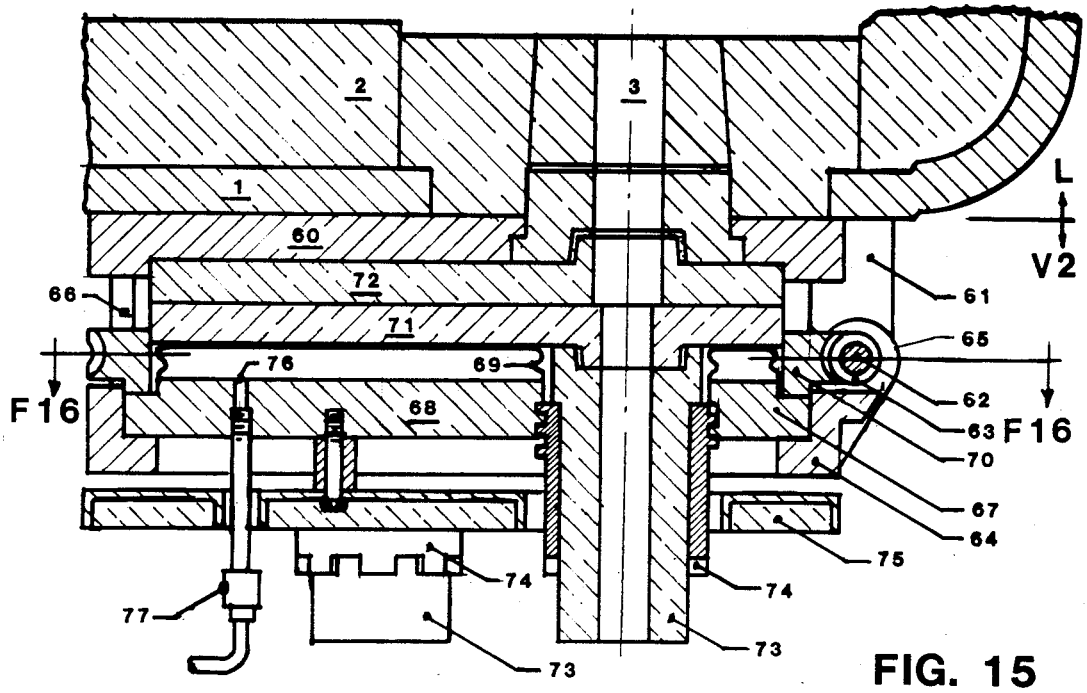
FIG. 15 is a vertical sectional view through a ladle and a rotary valve. The section line of FIG. 15 is shown as F15—F15 in FIG. 16.
Figure 16:
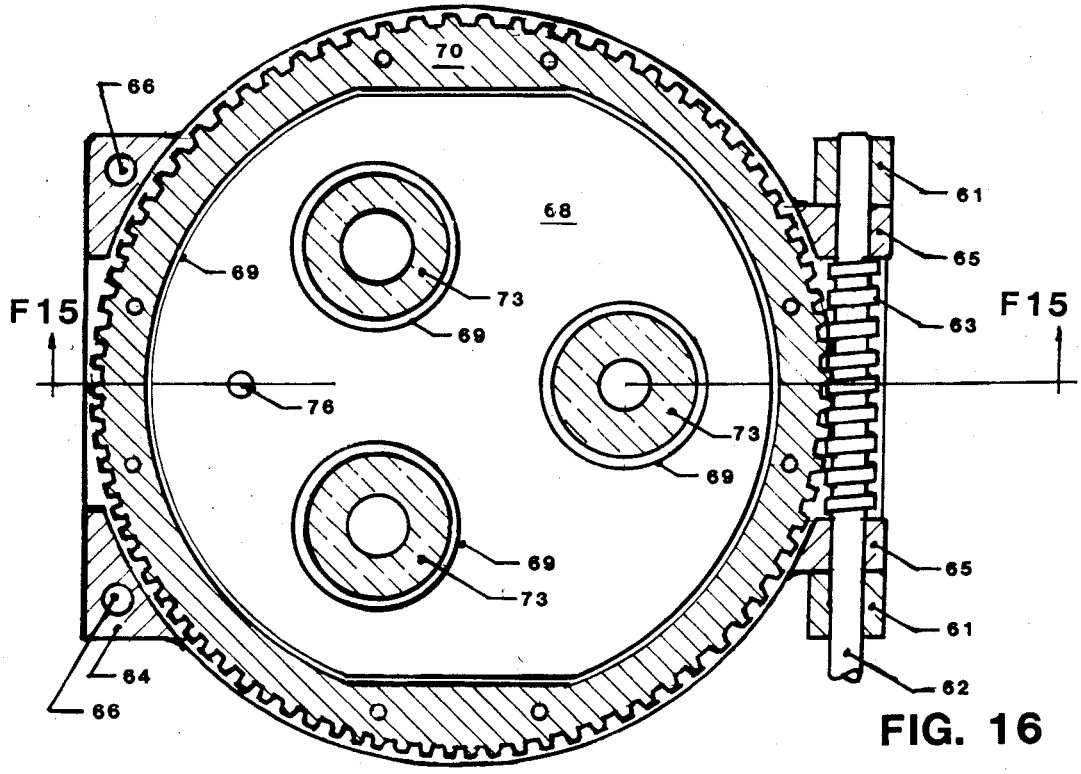
FIG. 16 is a horizontal sectional view through the rotary valve of FIG. 15. The section line of FIG. 16 is shown as F16—F16 on FIG. 15.

FIGS. 15 and 16 illustrate a rotary ladle valve $V_2$. FIG. 15 is a vertical sectional view and FIG. 16 is a horizontal sectional view taken along line F16—F16 of FIG. 15. Illustrated in these views are the ladle L and the rotary ladle valve $V_2$. The vessel or ladle L has an outer metal shell 1, a refractory lining 2, with a teeming orifice 3. The rotary ladle valve $V_2$ has a mounting plate 60 which is bolted to the bottom of the ladle outer metal shell 1. The mounting plate 60 has a depending journal portion 61 which supports the worm driving shaft 62. The rotary ladle valve frame 64 has a journal portion 65 which also surrounds the worm driving shaft 62. Thus, the worm driving shaft 62, in cooperation with the frame attachment bolts 66, support and position the rotary ladle valve frame 64 in a fixed position relative to the mounting plate 60.

Positioned within the rotary ladle valve frame 64 is the rotating valve plate carrier 67 which has a rigid bottom portion 68 and a flexible diaphragm portion 69 which is welded to the rigid bottom portion. Attached to the carrier 67 is the driven gear 70. When rotary power (which can be manual, electric, or hydraulic) is applied to the worm driving shaft 62, the worm gear 63 rotates and drives the driven gear 70 which in turn rotates the carrier 67. The rotating refractory orifice plate 71 is thus rotated relative to the stationary refractory orifice plate 72 which is retained by the mounting plate 60.

In the embodiment illustrated here, the rotating refractory orifice plate 71 has three different bore orifices. It could have 1,2,3 or more of the same or different sizes. Shut off of the teeming stream is accomplished by stopping rotation of the rotating refractory orifice plate intermediate to the teeming orifices. Teeming rates may be controlled by choosing the desired orifice bore size or by throttling by only partially opening one of the orifices.

Depending refractory nozzles 73 are held against the rotating refractory orifice plate 71 by nozzle retainers 74 which are threaded into the rigid carrier bottom 68. Suspended from the rigid carrier bottom 68 is a heat and splatter shield 75.

A passage 76, swiveled to its fluid pressure source by swivel 77, is shown to allow connection of the chamber within the carrier 67 to an outside pressure fluid source to allow controlled pressurization of the flexible diaphragm portion 69 of the carrier. When rotated, the line source is moved during shut off.

FIG. 16 illustrates many of the items of FIG. 15 but best shows how the flexible diaphragm portion of the carrier 69 surrounds the teeming orifices and applies a uniform controllable sealing pressure to the rotating refractory orifice plate 71.

OPERATION OF THE EMBODIMENTS

In the operation of the first alternative embodiment illustrated in FIGS. 1–5, the ladle is laid down on its side with the centerline of the toggle linkage pins 19, 23 and 24 vertical.

Using a spanner wrench, the nozzle retaining device 16 is unscrewed from the carrier 9 and removed. This permits removal of the depending refractory nozzle 11. Inspection of the stationary refractory orifice plate 6 may be made by observation through the orifice in the sliding refractory plate 10 while the valve is cycled through its travel. If the plate is satisfactory for further use, a new depending nozzle 11 is installed using a weak bonding mortar between the sliding refractory plate 10 and the upper end of the nozzle 11. A nozzle retaining device 16 is threaded into retain the nozzle. If the plates are not satisfactory for further use the pressure is relieved from the carrier and the toggle linkages opened. The valve frame 7, and its attached and contained components can then be swung open as if opening a door so that the refractory 6 and 10 may be inspected and or replaced.

After inspection and/or replacement of the plates, the valve frame 7 is swung closed and the toggles closed to position the frame in a predetermined position relative to the mounting plate 4. This position is such that a slight force caused by compression of the convolutions of the diaphragm upper portion of the carrier 14 holds the plates in an abutting relationship until a fluid under pressure is introduced through the passage of the carrier chamber 15, which pressurizes the chamber and applies a uniform force to essentially all of the lower surfaces of the sliding refractory plate 10 which surrounds the depending nozzle 11. This force is sufficient to deflect the refractory plate 10 which then yields to conform to the surface of the stationary refractory plate 6, and applies a near uniform pressure to the stationary refractory plate 6 causing it to yield and conform to the shape of the metal mounting plate 4. These plates are all initially as flat as it is practical to produce them but once in service at wide variations in temperature, warpage takes place and their flatness deteriorates and this deflection is necessary to maintain an abutting sealing relationship. This is particularly true while the sliding refractory components are moving in and out of teeming and shut off positions. The uniformly applied variable force of this device best maintains this sealing relationship.

When the frame 7 is closed and the plates are secured under fluid pressure a new depending nozzle 11 is prepared by applying mortar in its upper recess, then inserted against the sliding refractory plate and secured by screwing in the nozzle retaining device 16.

In normal practice, the ladle lining opening 3 is filled with sand or granular refractory material when the ladle is picked up. The fluid connection is removed and a check valve retains the pressure in the carrier while the vessel is taken to the furnace to receive its charge.

When the vessel reaches the teeming area, the fluid connection may be remade and by means of a pressure regulator the pressure applied to the sliding plate 10 and stationary plate 6 may be varied and may at all times be monitored by observing a simple pressure gauge in the system downstream from the regulator. If circulation of the fluid is desirable for cooling, applied pressure can be controlled by controlling the exhaust pressure out of an exhaust connection while fluid is introduced at a higher pressure into the fluid supply connection 15.

If teeming takes place in an inaccessible area such as in furnace charging, teeming into a secondary processing vessel, or reladling, the pressure connection will not need to be remade during teeming. The closed volume system will increase in pressure as the temperature of the device is increased by exposure to the convection and radiant heat. The increase in pressure in these conditions will normally be small as teeming will generally be limited to a single opening and rapid teeming. If desirable, the increase in pressure can be limited by the installation of a pressure relief valve.

The second and third alternative embodiments use swing bolts and fixed positioners to position the frame relative to the abutting plates. These embodiments vary from the first alternative embodiment in that the position of the closed frame in the first embodiment is predetermined and independent of the thickness of the individual set of plates which are installed in the valve. In the second and third embodiments the position of the closed frame is determined by locators 25, 30 and 31 which bear through the diaphragm 14 onto the sliding refractory plate 10 and thus the position of the closed frame is determined by the thickness of the actual set of plates installed in the valve. In operation, when the frame of the second and third embodiments is swung closed pivoting on the pin 29 connecting the hinge acting swing bolts 27 to the mounting plate 4. The latch acting swing bolts 28 are swung into position and the nuts of the swing bolts are hand tightened to position the stationary refractory plate 6, the sliding refractory plate 10, and the carrier 9 in abutting positions. The swing bolts are not used to apply the sealing force which is applied by the pressurized diaphragm 14 but are used to position the frame 7 and its encased carrier 9 in an abutting relationship to the abutting plates and thus provide an unyielding support for the plates. Therefore, the swing bolts do not need to be highly torqued but only tightened sufficiently to assure that the frame is properly positioned.

The locator bosses 25 of the second embodiment shown in FIGS. 6, 7 and 8 furnish unyielding support to the plates at multiple points (four points in this illustration), while the continuous outer support 30 and the inner support 31 surrounding the depending nozzle 11 of the third alternative embodiment illustrated in FIGS. 9, 10 and 11, combine to provide unyielding support to the critical areas of the plate.

A further benefit of this method of positioning the frame is that when pressurized and in operation the diaphragm has only to travel a minute amount and, therefore, unlike the diaphragm of the first embodiment, the diaphragms of the second and third embodiments do not need to be convoluted to accommodate this travel.

The embodiment of FIGS. 12, 13 and 14 is a three plate, sequential, side throttling tundish valve. While the embodiments of FIGS. 1–11 may be adapted to three plate operation and the embodiment of FIGS. 12, 13 and 14 may be adapted to two plate operation, this illustration is included to demonstrate a sequential type valve in which replacement plates may be inserted during teeming. The operation of a three plate, sequential side throttling tundish valve is fully explained in Shapland-King U.S. Pat. application No. 225,895 filed Jan. 19, 1981 and now U.S. Pat. No. 4,415,103 issued Nov. 15, 1983 and entitled "Full Trottle Valve and Method of Tube and Gate Change."

The valve TV is mounted on the tundish T, as shown. The valve plate 41 is shifted to a fully closed position and the tundish is then positioned over a continuous casting mold and lowered so that the submerged pour tube 48 is below the normal liquid level of the mold. Molten metal is then teemed into the tundish and when the tundish is half to two-thirds filled, the valve is moved to the full open position to rapidly fill the mold and initiate withdrawal of the cast slab, bloom or billet.

The valve plate is then moved back to a throttled position either under manual or automatic control to adjust the flow to the proper amount to maintain mold level while maintaining the desired withdrawal rate or casting speed.

As shown, an imperforate sliding gate plate 42 is kept in the ready position so that teeming may be stopped when the need arises.

Should it be desired to replace the working nozzle due either to errosion or a desire to greatly vary the speed of casting, the imperforate gate is removed from the ready position and a perforate gate is inserted in its place. The stop pin 53 is left in the submerged pour tube stop pin hole 52 and the gate and carrier changing cylinder is activated which pushes the new gate into position and ejects the worn gate plate.

In the event that it is desirable to replace the submerged pour tube due either to wear or clogging due to alumina build-up the following sequence is followed: the valve TV is shifted to full shut-off; the imperforate plate is inserted; the tundish is raised lifting the tube from the mold; the stop pin 53 is removed from the submerged pour tube stop pin hole 52; and a new perforate gate plate submerged pour tube assembly and carrier are inserted into the ready position and then the carrier pressurized. The gate and carrier changing cylinder is activated thereby pushing the new gate plate, submerged pour tube assembly and carrier into position under the stationary top plate orifice and ejecting the old components. After relieving the pressure in the ejected carrier, the ejected units may be removed from the frame and the stop pin 53, reinserted into the submerged pour tube stop pin hole 52. The tundish is then lowered and the stream restarted by moving the sliding orifice plate 41 to the open position. A new imperforate plate 42 is inserted into the ready position to be prepared for the next change. The pressurized chamber in the carrier maintains a uniform pressure in a surrounding relationship to the orifice at all times.

The operation of the rotary valve embodiment shown in FIGS. 15 and 16 is similar to the operation of embodiments of FIGS. 1–11, the principal difference being that controlling of the teeming stream is accomplished through rotation of a sliding refractory plate rather than reciprocation of a sliding refractory plate.

THE METHOD

The method of the invention achieves a liquid tight seal between the sliding surface of a sliding plate valve by utilizing a uniformly applied pressure over essentially the entire bottom surface of the sliding plate, excepting the depending nozzle portion, to uniformly deflect the sliding plate upwardly against the stationary plate and thus in turn deflect the stationary plate upwardly against a rigid back-up surface. As the sliding plate is moved between the open and closed positions, the sealing surface of the sliding plate rides on the sealing surface of the stationary plate even though this surface is not absolutely flat and even though the plates are not of absolutely uniform thickness.

Thus, the flatness and thickness tolerance applied to commercial plates may be increased and most if not all grinding operations can be eliminated, resulting in a cost savings and performance improvement.

The uniform pressure principle is applicable to refractories which are metal encased, bonded in, or banded, and to refractories which are symmetrical or assymmetrical. The stationary and sliding plates may optionally be identical or of different shape and/or thickness.

Although particular embodiments of the invention have been shown and described in full here, there is no intention to thereby limit the invention to the details of such embodiments. On the contrary, the invention is to over all modifications, alternatives, embodiments, usages and equivalents as fall within the spirit and scope of the invention, specification, and appended claims.

I claim:

1. A gate valve for a molten material containing vessel having a discharge orifice, comprising a valve frame secured to the vessel;

valve plates, one stationary and one movable, having at least one teeming orifice each;

said lower movable plate having a depending collector nozzle;

means for positioning the valve plates within the frame for relative movement one to the other;

means for moving said movable valve plate;

and means for applying a uniformly distributed force on the entire lower surface of said lower plate outside the depending collector nozzle.

2. The gate valve of claim 1, wherein the means for applying a uniformly distributed force comprises a fluid pressurized diaphragm means abutting the surface of one side of one of said valve plate components.

3. In the gate valve of claim 2, means for controlling the pressure of the fluid used to pressurize the diaphragm.

4. In the gate valve of claim 3, said control means positioned within the mechanism of the valve.

5. In the gate valve of claim 3, said control means positioned external to the mechanism of the valve.

6. In the gate valve of claim 2, means for circulating the fluid used to pressurize the diaphragm into and out of the valve.

7. In the gate valve of claim 2, a carrier proportioned to support the sliding valve plate;

said diaphragm means comprising the upper portion of said carrier.

8. In the gate valve of claim 7, said means for moving the valve plate being operatively connected to the carrier which supports the valve plate.

9. A gate valve for a molten material containing vessel having a discharge orifice comprising, in combination, valve plates in interface relationship, at least one stationary plate and at least one movable plate each plate having at least one teeming orifice;

a depending collector nozzle in teeming relationship with the movable plate orifice;

means for mounting said stationary plate in teeming relationship with the discharge orifice of the vessel;

a carrier support frame secured to the molten material containing vessel;

a carrier for said movable valve plate proportioned to move within the frame;

one or more means for moving the carrier within the frame;

means for positioning said movable valve plate on the carrier;

means for applying a uniformly distributed pressure fluid force to the entire lower surface of the movable plate circumambient to the collector nozzle;

means for removably securing said carrier and carrier support frame to said vessel in order to facilitate replacement of said valve plates;

and means for limiting the secured position of said carrier and carrier support frame.

10. In the valve of claim 9, wherein the means for limiting the secured position of said carrier and said support frame is a group of non-adjustable toggle linkages that return the said support frame to a predetermined position.

11. In the valve of claim 9, wherein the means for limiting the secured position of said carrier and said support frame are non-yielding supports abutting the movable valve plate.

12. In the valve of claim 9, wherein the means for limiting the secured position of the said carrier and said support frame is one or more locator bosses within the said carrier that bear upon the movable valve plate.

13. In the valve of claim 9, wherein the means for limiting the secured position of the said carrier and said carrier support frame is a raised portion of the carrier that bears on the periphery of the movable valve plate.

14. In the valve of claim 9, wherein the means for limiting the secured position of the said carrier and said carrier support frame is a raised portion of the carrier that bears on an area that circumambiates the depending nozzle portion of the movable plate.

15. In the valve of claim 9, wherein at least one of the means for moving the carrier within the frame reciprocates the carrier to move an orifice of a movable valve plate into and out of alignment with an orifice of a stationary valve plate.

16. In the valve of claim 9, wherein at least one of the means for moving the carrier within the frame enables rotation of the carrier so as to move an orifice of a movable valve plate into and out of alignment with an orifice of a stationary valve plate.

17. In the valve of claim 9, wherein at least one of the means for moving the carrier within the frame enables sequentially replacing the movable valve plate with a replacement valve plate.

18. In the valve of claim 9, wherein at least one of the means for moving the carrier within the frame provides for moving the orifice of a movable valve plate out of alignment with an orifice of a stationary valve plate, to provide throttling of the stream passing through the combined orifice.

19. In the valve of claim 9, wherein the means of removably securing said carrier and carrier support frame to said vessel is one or more toggle linkages.

20. In the valve of claim 9, wherein the means of removably securing said carrier and carrier support frame to said vessel is one or more swing bolts with adjustable nuts.

21. In the valve of claim 9, wherein the means of removably securing said carrier and carrier support frame to said vessel is adjustable.

22. In the valve of claim 9, wherein the means of removably securing said carrier and carrier support frame to said vessel is non-adjustable.

23. In the valve of claim 9, wherein the means for applying a uniformly distributed force is a flexible diaphragm with an annular fluid chamber therebeneath, said flexible diaphragm abutting the valve plate.

24. In the valve of claim 23, wherein an inward extending flange means structurally cooperates with said flexible diaphragm that abuts and supports the valve plate to additionally support at least one flow passage component.

25. In the valve of claim 24, wherein the inwardly extending flange is integral with the flexible diaphragm.

26. In the valve of claim 24, wherein the inwardly extending flange support rests on the flexible diaphragm.

27. In the valve of claim 9, wherein inward extending flange means structurally cooperate with the flexible diaphragm that abuts and supports the valve plate to additionally support two flow passage components, e.g., depending nozzles or submerged pour tubes.

28. In the valve of claim 27, wherein the inwardly extending flange is integral with the flexible diaphragm.

29. In the valve of claim 27, wherein the inwardly extending flange support rests on the flexible diaphragm.

30. In the method of controlling the flow of molten material from a teeming vessel having a teeming orifice, a stationary valve plate having an orifice, a movable plate having an orifice in open communication with a collector nozzle depending from the movable valve plate supported by said carrier, a carrier having a pressure chamber closed by a flexible barrier said flexible barrier engaging the entire underside of the movable plate circumambient the collector nozzle, a support frame for the carrier, and a means for moving the movable plate, the step of pressurizing the chamber with a fluid to force the valve plates into sealing abutment with each other.

31. In the method of claim 30, positioning yielding support between the carrier and sliding plate.

32. In the method of claim 30, positioning non-yielding support between the carrier and sliding plate.

33. In the method of claim 30, positioning a rigid support member in spaced communication with the chamber, and securing the carrier to the support frame with the support member contacting the movable plate prior to pressurizing the chamber.

34. In the method of controlling the flow of molten material from a teeming vessel having a teeming orifice, a stationary valve plate, a carrier having a pressure chamber closed by a flexible barrier, a movable valve plate supported by said carrier flexible barrier, a support frame for the carrier, and a means for moving the movable plate, the steps of supporting a depending nozzle against the surface of the movable plate by means of a flange projecting inward from and supported by the flexible barrier, positioning the flexible barrier to underly substantially all of the movable valve plate and circumambient to the depending nozzle, and pressurizing the chamber with a fluid to urge the nozzle and movable valve plate against the stationary plate.

35. In the method of claim 33,
positioning yielding support between the carrier and sliding plate.

36. In the method of claim 34,
positioning non-yielding support between the carrier and the sliding plate.

37. In the method of claim 34,
positioning a rigid support member in spaced communication with the chamber,
and securing the carrier to the support frame with the support member contacting the movable plate prior to pressurizing the chamber.

38. A sliding gate valve for a molten metal teeming vessel having a discharge orifice, comprising
a valve frame secured to the vessel,
opposed refractory plates one movable and one fixed, each one having a teeming opening,
a carrier for said movable plate positioned within the frame,
a collector nozzle depending from the movable plate in teeming relationship therewith,
means for moving the carrier,
a carrier diaphragm sealed interiorly of the carrier and positioned for pressure engagement with the sliding one of said plates on substantially all of its undersurface and circumambient the collector nozzle,
a pressure source in open communication with said diaphragm,
said diaphragm being in uninterrupted surrounding engagement with said teeming opening of said sliding plate having a teeming opening.

39. In the sliding gate valve of claim 38 above,
said diaphragm being convoluted.

40. In the sliding gate valve of claim 38 above,
slide plate retainers in said carrier to engage the sliding one of said slide plates.

41. In the sliding gate valve of claim 38 above,
said carrier having stop portions for engaging said frame independent of pressurizing said diaphragm.

42. In tne sliding gate valve of claim 38 above,
a plurality of orifices in said slide plate having a teeming opening.

43. In the sliding gate valve of claim 38 above,
said movable plate having a teeming opening with a pour tube.

44. In the sliding gate valve of claim 38 above,
a pour tube being threadedly engaged with said carrier.

45. In the sliding gate valve of claim 38 above,
said carrier being secured to the frame by means of opposed swing bolts,
adjacent ones of said swing bolts being retained in the frame,
adjacent ones of said swing bolts being hinged to move out of position and permit said carrier to be hingedly removed from said frame.

46. A sliding gate valve having three plates at least two of which have a teeming opening for use therein, comprising,
a frame,
said frame supporting a carrier,
means in said carrier for supporting a submerged pour tube holder,
and a flexible yieldable pressure device surrounding the teeming opening having means for receiving fluid under pressure and in pressure communication with the lower one of said plates and underlying substantially all of the underneath portion of the lower of said three plates.

47. In the sliding gate valve of claim 46,
said flexible yieldable pressure device being toroidal.

48. In the sliding gate valve of claim 46,
drive means for throttling the center of said plates.

49. In the sliding gate valve of claim 46,
travel limit portions extending upward from the carrier bottom and within the flexible yieldable pressure device.

50. In the sliding gate valve of claim 46,
said flexible yieldable device being annular.

51. In the sliding gate valve of claim 50,
holes for receiving a pour tube holder stop pin,
holes for receiving a middle plate stop pin,
and means for insertion of stop pins in said holes to stop either the pour tube holder or middle plate against movement within the frame.

52. In the sliding gate valve of claim 46,
said flexible yieldable pressure device being a diaphragm.

53. In the sliding gate valve of claim 52,
said diaphragm being convoluted.

54. In the sliding gate valve of claim 52,
said carrier having stop portions for engaging said frame independent of pressurizing said diaphragm.

55. In the sliding gate valve of claim 52,
all three of said plates have a teeming opening.

56. In the sliding gate valve of claim 52,
a pour tube nozzle support flange proportioned to engage the diaphragm and support tube.

57. A rotary gate valve for a molten material containing vessel having a discharge orifice, comprising
a rotary valve frame secured to the vessel;
a rotary valve carrier positioned within the frame,
a rotary valve plate having at least one teeming orifice positioned within said carrier;
means for positioning a stationary valve plate within the frame in open communication with the vessel discharge orifice;
means for rotating said rotary valve plate and carrier;
and means for applying a uniformly distributed force to said rotary valve plate on an area circumambient to said teeming orifice and underlying substantially all of the lower surface of said rotary valve plate.

58. In the rotary gate valve of claim 57, wherein the means for applying a uniformly distributed force comprises a fluid pressurized diaphragm means abutting substantially all of the surface of one side of one of said valve plate components.

59. In the rotary valve of claim 58, means for circulating the fluid used to pressurize the diaphragm into and out of the valve.

60. In the valve of claim 58,
said carrier having a pressure chamber valve plate;
said diaphragm means comprising the upper portion of said chamber.

61. In the rotary valve of claim 58, means for controlling the pressure of the fluid used to pressurize the diaphragm.

62. In the rotary valve of claim 61, said control means positioned within the mechanism of the valve.

63. In the rotary valve of claim 61, said control means positioned external to the mechanism of the valve.

* * * * *